US006910424B2

(12) United States Patent
Ruocchio et al.

(10) Patent No.: US 6,910,424 B2
(45) Date of Patent: Jun. 28, 2005

(54) MOVABLE MODEL TRAIN CAR PARTS TO AID MODEL TRAIN MANEUVERABILITY AS IT TRAVELS ON MODEL RAILROAD TRACK

(75) Inventors: Albert C. Ruocchio, Raleigh, NC (US); Frederick W. Terrell, Jr., Mebane, NC (US)

(73) Assignee: Albert C. Ruocchio & Associates, Inc., Raleigh, NC (US)

( * ) Notice: Subject to any disclaimer, the term of this patent is extended or adjusted under 35 U.S.C. 154(b) by 0 days.

(21) Appl. No.: 10/638,556

(22) Filed: Aug. 12, 2003

(65) Prior Publication Data

US 2004/0103812 A1 Jun. 3, 2004

Related U.S. Application Data

(60) Provisional application No. 60/402,553, filed on Aug. 12, 2002.

(51) Int. Cl.[7] ..... B61D 17/00

(52) U.S. Cl. ..... 105/3; 105/4.1; 280/99; 296/198

(58) Field of Search ..... 105/1.5, 3, 15, 105/4.4, 4.1, 8.1, 1.4, 18, 10, 4.3, 199.1, 199.2; 296/198; 180/237, 235; 280/99, 100, 101

(56) References Cited

U.S. PATENT DOCUMENTS 1,142,150 A 6/1915 Domill
1,542,139 A 6/1925 Ives
1,564,337 A 12/1925 Fischbach
2,010,350 A * 8/1935 Davis ..... 280/849
2,133,530 A 10/1938 Beutlich
2,778,508 A * 1/1957 Beger ..... 213/211
2,779,133 A 1/1957 Zion
2,872,051 A 2/1959 Dunbar
3,608,237 A 9/1971 Richter
3,952,450 A 4/1976 Edwards et al.
4,274,337 A 6/1981 Shaw
4,522,607 A 6/1985 Kilroy et al.
5,398,619 A * 3/1995 Buccos ..... 105/157.2
5,816,169 A 10/1998 MacKenzie
6,161,064 A * 12/2000 Strasser et al. ..... 701/19
6,189,713 B1 * 2/2001 Oh ..... 213/75 TC
6,250,231 B1 6/2001 Karasek

* cited by examiner

*Primary Examiner*—Frantz F. Jules
(74) *Attorney, Agent, or Firm*—John P. Shannon

(57) ABSTRACT

A model electric train car possessing various movable parts which allow the train car's pivotally-mounted truck and coupler assembly to maneuver around tight curves without interference from model train steps, skirts or other train car parts in close proximity to the train coupler, thereby, avoiding derailment of the toy train. The steps, skirts or other train parts to swing, slide, rotate, or otherwise move away from the truck and coupler assembly, being attached to the train car by pins, hinges, slides, snap connectors or the like to allow the free movement of the train parts.

30 Claims, 11 Drawing Sheets

MOVABLE MODEL TRAIN CAR PARTS TO AID MODEL TRAIN MANEUVERABILITY AS IT TRAVELS ON MODEL RAILROAD TRACK

CROSS REFERENCE TO RELATED APPLICATION

This application claims priority to Provisional Application No. 60/402,553, filed Aug. 12, 2002 and incorporated herein by reference.

BACKGROUND OF THE INVENTION

1. Field of Invention

The present invention relates to a two-rail or three-rail model electric train car with at least one pivotally-mounted coupler and truck assembly to maneuver around curves on a model railroad train track.

2. Discussion of Prior Art

This present invention is intended for use with model electric train cars operating on a two-rail or three-rail continuous track system typical of the layout depicted in U.S. Pat. No. 1,142,150 to Dorrill. Dorrill presents one of the most basic configurations of model railroad track, a simple oval design of a straight and cured track sections. Although much more complicated layout designs can be created, the basic concepts still apply of the train traveling either in a straight line or around a curve.

Unfortunately for many electric model train owners, often there is only a limited area in which to set up a train track layout to operate a model toy train. A standard, small size layout would consist of straight and curved track sections forming an oval with a 30" or 31" radius curve. Because of the sharpness of the curve due to the limited space, a problem often reoccurs during train operation especially when the train setup includes train cars of longer lengths such as passenger cars: as the long train car rounds the curve, the truck and coupler assembly will make contact with any train car parts in close proximity to said assembly. In particular, the contact may be with the model train steps or model train skirt, or side panels, of the train car. The contact may cause derailment and damage of the electric model train. Given these restrictions, many model train operators are not able to operate scale size train cars on their layouts and must limit operation to semi-scale train cars which are not as long and have a shorter wheel base than the prototypical, longer scale train cars.

This situation does not present a problem in monorail systems. Because the wheels run on a single middle track, there is no reason for any interference or contact with the train or parts of the train. Several patents related to monorails exist. One such patent is U.S. Pat. No. 5,816,169 by MacKenzie. The patent describes the operation of a monorail system and, also, shows sides or skirts of the train which extend down over the wheels and part of the rail. These parts are commonly added for protection and aesthetic purposes to cover the mechanisms under the monorail train, but, due to the operation on a single track, the sides or skirts do not interfere with the train operation.

This type of contact between the coupler and truck assembly and the train car body is not the only cause for model train derailment. Train manufacturers have implemented several designs to minimize derailment. Most effective are control systems, often remote control systems, that regulate the speed of the train as it rounds a curve. Some have also applied physical features to address this common problem. U.S. Pat. No. 4,522,607 to Kilroy et al. includes a feature in the track design which reduces the train speed at specified locations on the track. In U.S. Pat. No. 1,564,337 to Fischbach, the objective is to provide a guard rail attached to the track in order to prevent derailment. U.S. Pat. No. 4,274,337 to Shaw discloses a locomotive with two sets of driving wheels which operate independently from each other in order to provide improved operation of the locomotive. While these disclosed inventions provide solutions to the problem of derailment, none would prevent the derailment caused by contact between the truck and coupler assembly and part of the train car itself.

It may be useful to examine briefly the basic common type of coupler and truck assembly used on electric toy trains to aid in understanding of how the coupler and truck assembly operate and are affected by any close proximity of any of the parts of the train body itself. Both U.S. Pat. No. 1,542,139 to Ives and U.S. Pat. No. 2,133,530 to Beutlich present the basic common electric model train truck design. Each truck assembly consists of a frame, two axles each with two wheels, a bolster positioned between the two axles, and some type of connection feature in the middle of the bolster to connect the truck assembly to the model train car. Both inventions also reveal another common practice among train manufacturers which is to add detail to the outside side frame so that the outward appearance of the model toy train truck is similar to the appearance of full-size train trucks. The most crucial elements of these and similar designs to the application of this present invention is that the truck assemblies are pivotally or swively mounted to the train car body and the trucks operate in a lateral, horizontal fashion.

Many inventors have chosen to attach, by any of various means, the coupling assembly to the truck assembly. Although it is possible to attach the coupler mechanisms to the model train body itself, toy train manufacturers have discovered through years of research and testing that combining the coupler and truck assemblies is very effective for model electric train operation. The two basic elements of the coupler assembly consists of a coupler arm, attached to the truck assembly, which extends out an appropriate length from the truck assembly to the front or rear of the train car and the coupling mechanism. The present invention is capable of being used with all types of coupler and truck assemblies. Thus, this present invention is not limited to a particular design of coupling mechanism, but can be utilized with any of numerous types of coupler and truck assemblies. U.S. Pat. No. 3,608,237 to Richter reveals an important benefit of joining the coupler assembly to the truck assembly. It discloses that this feature allows model train cars to couple and uncouple on curved sections of track as well as straight sections of track. U.S. Pat. No. 2,872,061 to Dunbar displays a good illustration in its FIG. 1 of two typical train cars, situated on model railroad track, coupled together. In addition, FIGS. 3 and 4 illustrate a pair of coupled truck and coupler assemblies situated on model railroad train track. Although, Richter and Dunbar present their own unique features, both patents describe the basic elements of a typical model toy train truck and coupler assembly.

SUMMARY OF THE INVENTION

The present invention is especially suitably applied to model passenger cars, because full-size train passenger cars operated by railroads often include steps, skirts, or side panels near the train wheels as part of their design.

It is important to a model toy train manufacturer to replicate the passenger car as accurately as possible.

Although the proximity of steps, skirts, side panels, or the like did not interfere with full-size train operation, since railroads avoided constructing very sharp curves in the railroad lines for safety reasons, these designs, however, do present a problem to the model train manufacturer when the steps, skirts, side panels or the like interfere with the operation of the model pivotally-mounted truck and coupler assembly as it maneuvers around tighter curves in the model train track. In model passenger car designs which do not include a pivotally-mounted truck and coupler assembly, this occurrence of interference may not exist. In U.S. Pat. No. 2,779,133 to Zion, the coupler assembly is separate from the truck assembly and designed to create a certain streamlined appearance.

Although the present invention is more often used with passenger cars, its features can be implemented in model train engines and model train rolling stock cars where any train part attached to the train car body exists in close proximity to the truck and coupler assembly. As with the passenger cars, the chance of contact is greatest among cars of longer lengths as they negotiate sharp curves. An example of a freight car with steps located near the trucks and couplers is shown in U.S. Pat. No. 3,952,450 to Edwards et al., which discloses a method of manufacturing and assembling flexible plastic steps onto a model train boxcar. The objective of the type of construction disclosed by Edwards et al. is to prevent breakage of small parts, such as the steps, during the course of manufacturing, finishing, assembling, packing or handling the model toy train product. Edwards et al. does not disclose whether the use of flexible plastic steps, instead of a more rigid material, prevents interference with the train car coupler and truck assembly as it maneuvers around sharp track curves and, thereby, prevents possible derailment, or whether the utilization of the flexible steps improves model train operation in any way. One possible disadvantage, especially when applied to higher-cost train cars, is that the plastic might give the impression that the quality of the product is not as high as that of products that use metal steps or other metal accessory-type parts.

Toy train manufacturers have had few solutions to this space restriction except to set and to advertise recommended train circumferences acceptable for various length train cars. Therefore, hobbyists with small layouts have been limited to operating only smaller length train cars. There is one prior design that Lionel has implemented since the 1950's on certain types of toy diesel engines wherein the fixed steps are actually part of the truck and coupler assembly and not attached to the train shell or body at all. While this design achieves the objective of avoiding contact with the train, the permanent steps on the wheel assembly is not prototypical and gives an unusual and unnatural look especially as the train does round the curve and the steps move out with the truck assembly away from the train making it more obvious that the steps are not connected to the model train car body but to the truck and coupler assembly. The present invention offers an improved solution that both allows the steps to remain attached to the train car body replicating the full-size trains more accurately and provides a means of preventing contact resulting in derailment.

On model toy train cars, it is important to both manufacturers and consumers to include the steps to make the train car look as realistic as possible. Model train collectors have high standards for maintaining the protypical appearance of the models in relation to the full-size trains, and even small details will influence their purchasing decisions. Despite the importance of placing the steps in the proper location on the train, the steps often interfere with the truck and coupler assembly during operation. The improvement of this design over previous designs of molded steps or permanently fixed steps allows the flexibility of movement by manufacturing the steps as a separate piece and then attaching the steps to the train car by hinges or pins or a slide or other means so that if the truck and coupler assembly does come into contact with the steps, then the steps will have enough leeway of movement that they will be pushed aside and not maintain resistant contact with the train wheels and thereby avoid a train derailment or stoppage of operation or other malfunction. If hinges or pins allowing pivot are utilized, the steps could either swing out or swing up.

Another option in design of the train steps would allow the operator to slide the steps up under the train chassis during operation and therefore no object would be hanging down to cause interference; the steps the could be easily lowered back into position. Another way to achieve the same result would involve a design of steps that could snap on and off the train car. The main disadvantage of these two designs is that the steps would not be present on the train car while the train is in operation on the track; however, the objective of avoiding possible derailment would be achieved by using these methods, and the train car steps could easily be repositioned or reattached for display.

Model train enthusiasts value having a good looking train to display and appreciate as well as having a train that operates well on their model train layout.

Another common feature of model railroad passenger cars and some other model train cars is a side skirt or thin side panel that extends the length of at least some portion of the train car and below the bottom of the train undercarriage or chassis. The intent of the skirt, as designed by railroads for full-size cars, is mainly aesthetical and decorative. 50's and 60's style train cars often included this skirt feature, and it is important for model toy trains manufacturers that replicate trains from this era to include this feature as well. In model toy train manufacturing, there has been the difficulty of designing a train skirt to be positioned realistically and with a prototypical look without causing interference with train operation around curves in the track. This present improvement provides attachment of the skirt to the train car by hinged or sliding means so that the skirt can slide or swing or otherwise move out of the way of the truck and coupler assembly as contact is made between said assembly and said skirt. The skirt could be designed either to swing up or to swing out or slide in by various attachment means.

DETAILED DESCRIPTION OF THE PREFERRED EMBODIMENTS

Figure 1:
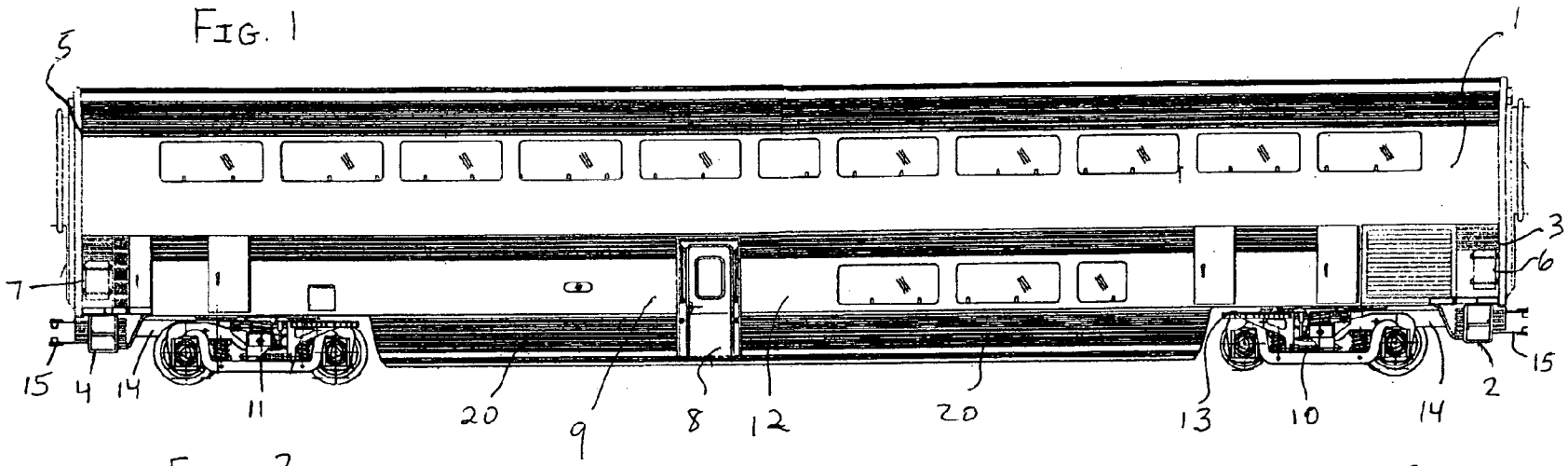
FIG. 1 is a side elevation of a model train passenger car according to the present invention with steps in close proximity to the truck and coupler assembly.

Referring now to FIG. 1, a model electric train passenger car 1 is presented; the passenger car is designed to include front steps 2 near the front of the car 3 and rear steps 4 near the rear of the car 5. The front steps and rear steps provide access to front ladder 6 and rear ladder 7, respectively. Such steps and ladders on full-size train cars are intended for use by railroad workers and are not intended for use by passengers. Doorways 8 for passengers entering and exiting, in most cases, do not employ steps, but the height of the doors is calculated and designed to be positioned corresponding to platform height at railroad depots along the railroad lines or routes. Typically, the passenger doorways are located either near the center of the train car 9 or at one or both ends of the car.

It can be observed from FIG. 1 that both the front truck and coupler assembly 10 and the rear truck and coupler assembly 11 of the model car 1 are in close proximity to parts of a train car body 12 that extends down lower than the train car chassis 13, depicted here by the front step and rear step. In this design, it is primarily the coupler arm 14 and coupling mechanism 15 of the truck and coupler assemblies running lengthwise along the undercarriage 16 of the train car body and alongside the front step or rear step that are in closest proximity with the steps. However, this may not be the case in other car designs, wherein the truck assembly portion can come into contact with steps, skirts or other train car parts extending below the chassis.

Figure 2:
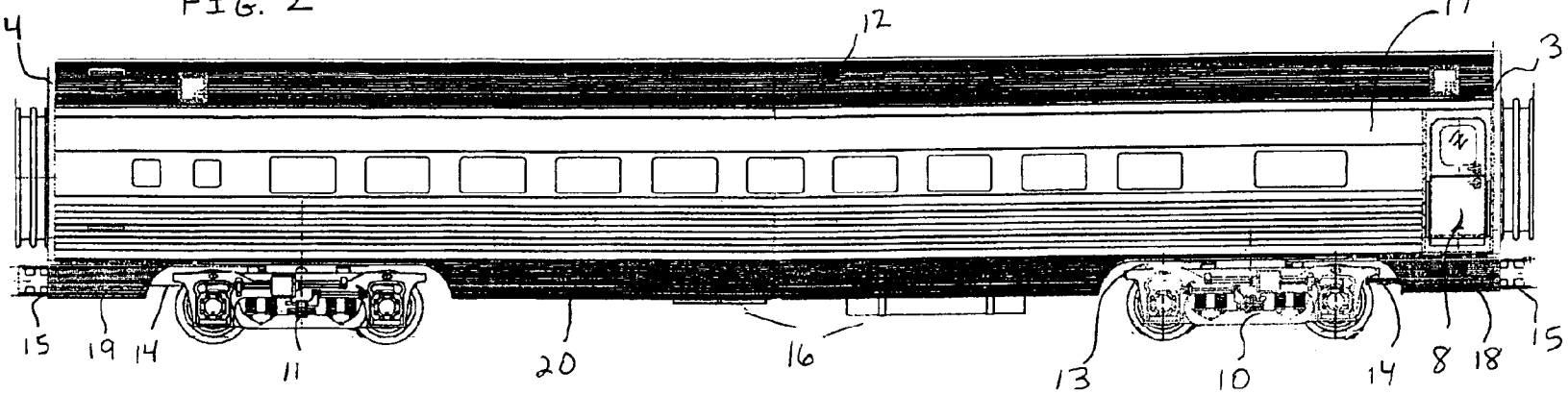
FIG. 2 is a side elevation of a model train passenger car according to the present invention with skirts in close proximity to the truck and coupler assembly.

Similarly, FIG. 2 presents a model electric train passenger car 17. In this case, however, the passenger car has a front skirt 18, or side panel, and a rear skirt 19. This particular design shows one doorway near the front of the car over the front skirt, but no doorways appear at the rear of the car over the rear skirt. The front and rear truck and coupler assemblies are in close proximity to the front skirt and the rear skirt. The center skirt sections 20 are not located in such a way that they could cause interference with either the front or rear truck and coupler assemblies. The front, center and rear skirts cover and protect train car undercarriage mechanisms.

Figure 3:
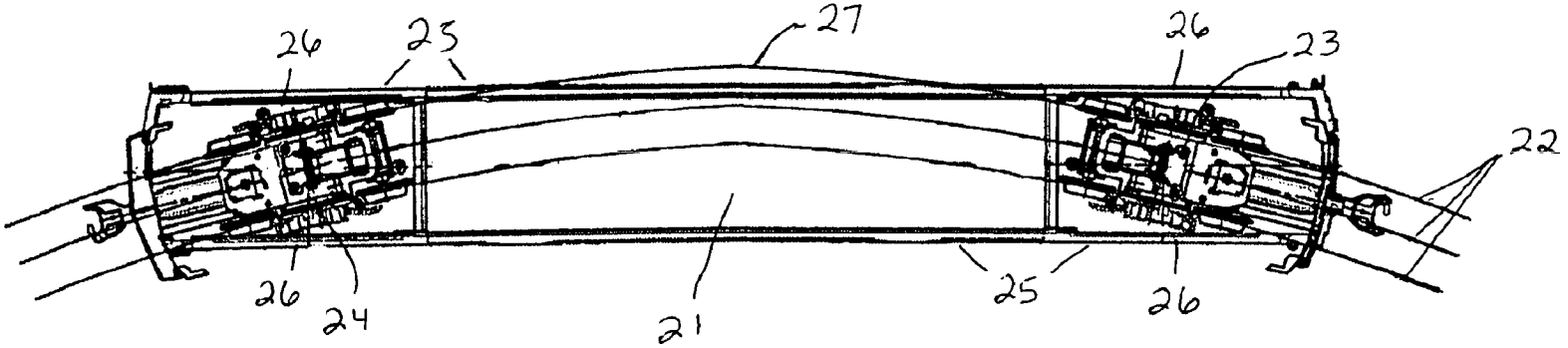
PRIOR ART FIG. 3
FIG. 3 is a bottom plan view of a known model passenger car rounding a track curve, with restriction in allowable curve radius because of possible interference with the skirt sides.

FIG. 3 displays the underside of a model railroad train car 21 rounding a three-rail model railroad train track curve 22, which has been superimposed schematically. Also viewed are the underside of the front truck and coupler assembly 23, the underside of the rear truck and coupler assembly 24, and the sides of the train car body 25, including any parts or sections of the train car which extend down below the train car chassis into the undercarriage area of the train. By the solid lines of the train car body sides, this illustration depicts a known train car which has fixed or unmovable train sections 26 that allow limited and restricted movement of the front and rear truck and coupler assembly. Thereby, the radius or arc 27 of the curved track section that is negotiable by the car is also limited.

Figure 4:
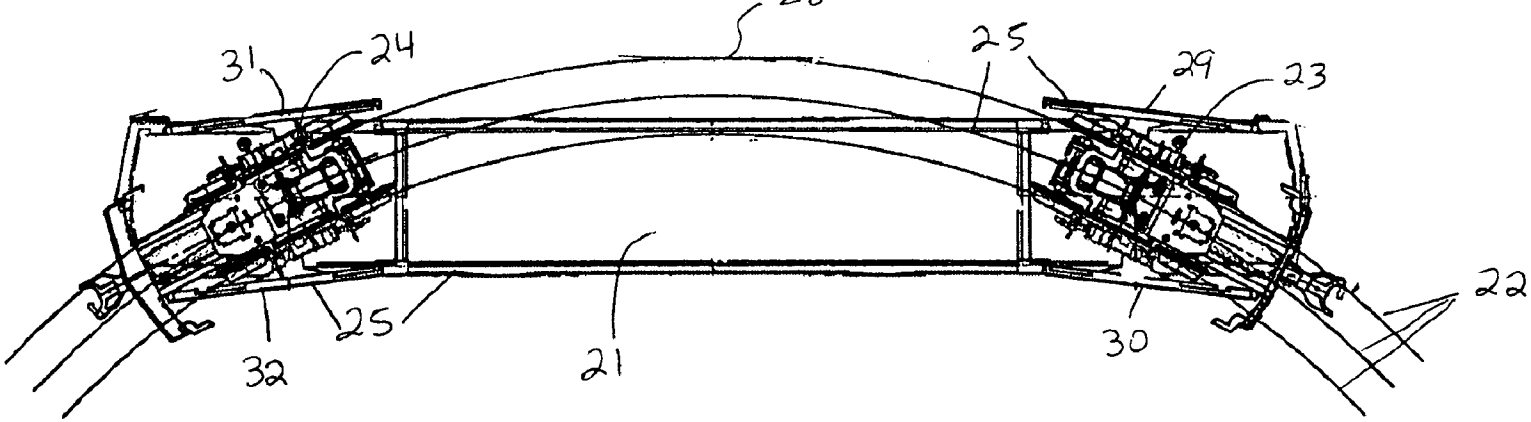
FIG. 4 is a bottom plan view of a model passenger car according to the present invention rounding a sharper radius track curve with less restriction because of movable side skirts that swing out upon contact with the truck and coupler assembly.

Referring now to FIG. 4, the underside of a train car body according to the present invention, including front and rear assemblies, rounding a model train track curve is shown. However, the curvature 28 of this second curve track section is much greater. The train car body has movable left and right front parts 29, 30 and movable left and right rear parts 31, 32, the bottom of the part sections moving away or out from the train car as they come into contact with the front and rear truck and coupler assemblies. The result is less restriction of movement to the truck and coupler assembly.

Figure 5:
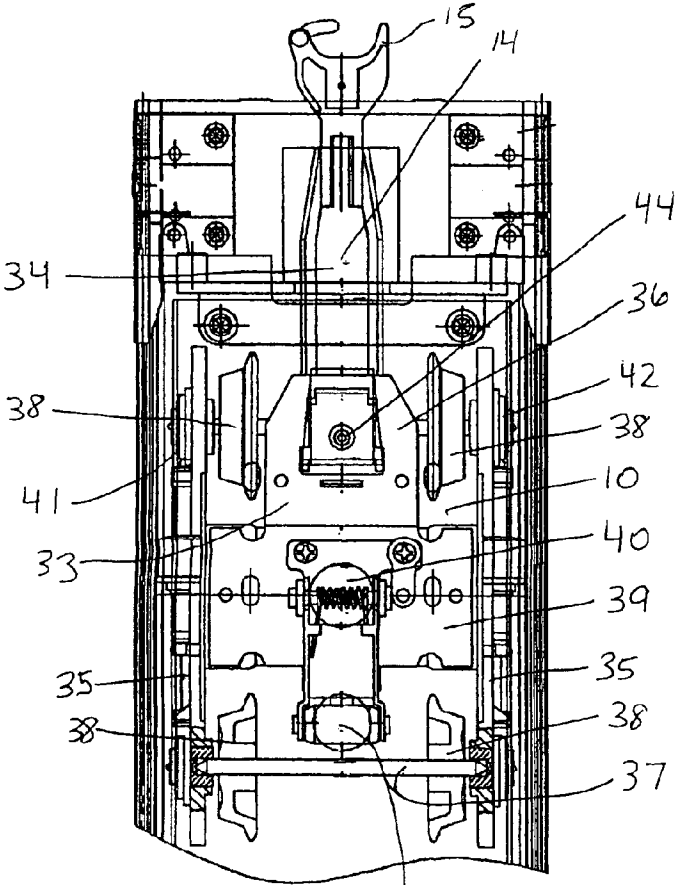
FIG. 5 is a bottom plan view of a typical truck and coupler assembly pivotally-mounted on a train passenger car.

FIG. 5 shows the underside of a typical pivotally-mounted truck and coupler assembly attached to a train car body. This design incorporates two functions of the train car, the truck assembly 33 and the coupling and uncoupling assembly 34, into the same assembly. Since the two assemblies are attached, they operate in the same lateral fashion and cannot move in opposite directions. The main features of the truck assembly include a truck frame 35, a front axle 36 and a rear axle 37, wheels 38, a bolster 39, and a connection 40. The bolster, usually constructed of a solid metal strip, is attached to the truck frame between the outer side truck frame 41 and the inner side truck frame 42 and runs the length of the frame parallel to the front axle and the rear axle. In the center of the bolster, any of various connections 43 can be utilized to connect the truck assembly to the train car body. Often a bolt extends down from the train car body into an opening in the truck assembly, but whatever the connection, the main objective of the connection is to provide pivotal and lateral movement of the truck assembly in relationship to the train car body. Another common feature of the truck assembly found in three-rail model train track setups, but not critical to the present invention, is the roller pickup 44 usually located on the bolster. The roller pickup touches the middle track rail during train operation and draws electricity from the third rail. The coupling and uncoupling assembly, often attached to the truck assembly of model railroad train cars, consists primarily of a coupler arm which extends out towards the end of the train to position the coupling and uncoupling mechanism in the desired location to couple with the next train car. The connecting means 45 connecting the coupler arm to the truck assembly can have various constructions, the important factor being that the coupler assembly is in a fixed position relative to the truck assembly, whereby the two assemblies operate in the same direction at all times and are not capable of moving in opposite directions.

Figure 6:
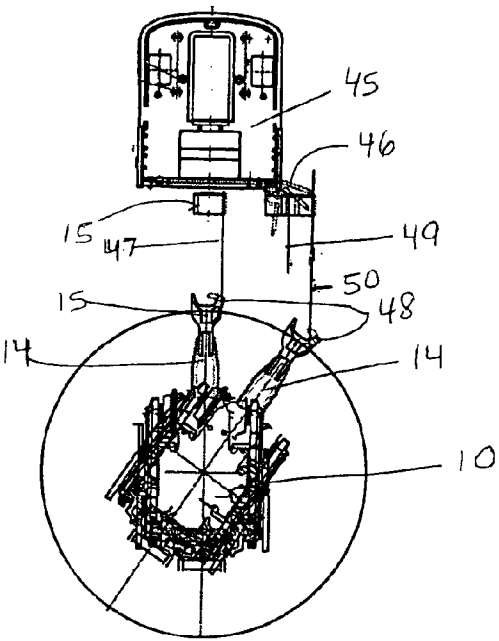
FIG. 6 PRIOR ART
FIG. 6 is a schematic view showing lateral movement of a pivotally-mounted truck and coupler assembly like that of FIG. 5 in relation to the movable steps of a passenger car according to the present invention.

The type of pivotally-mounted truck and coupler assembly of FIG. 5 is also shown in FIG. 6, along with a schematic showing of a rear side of a train car 46 according to the present invention. The train car has a movable step 46, to the side of the train car, that extends lower than the train car chassis, contacting between the coupling mechanism located near the end of the passenger car and in close proximity to the movable step. Line 47 corresponds to the right side of the coupler mechanism 48 on the truck and coupler assembly in its centered alignment on the train car. Line 49 indicates the point of contact between the right side of the coupler mechanism and the side train car steps. Since the steps are movable, line 50 shows the additional distance allowed the truck and coupler assembly, giving the train car a tighter allowable turning radius without derailment, compared with a conventional step, which is resistant to movement.

Figure 7:
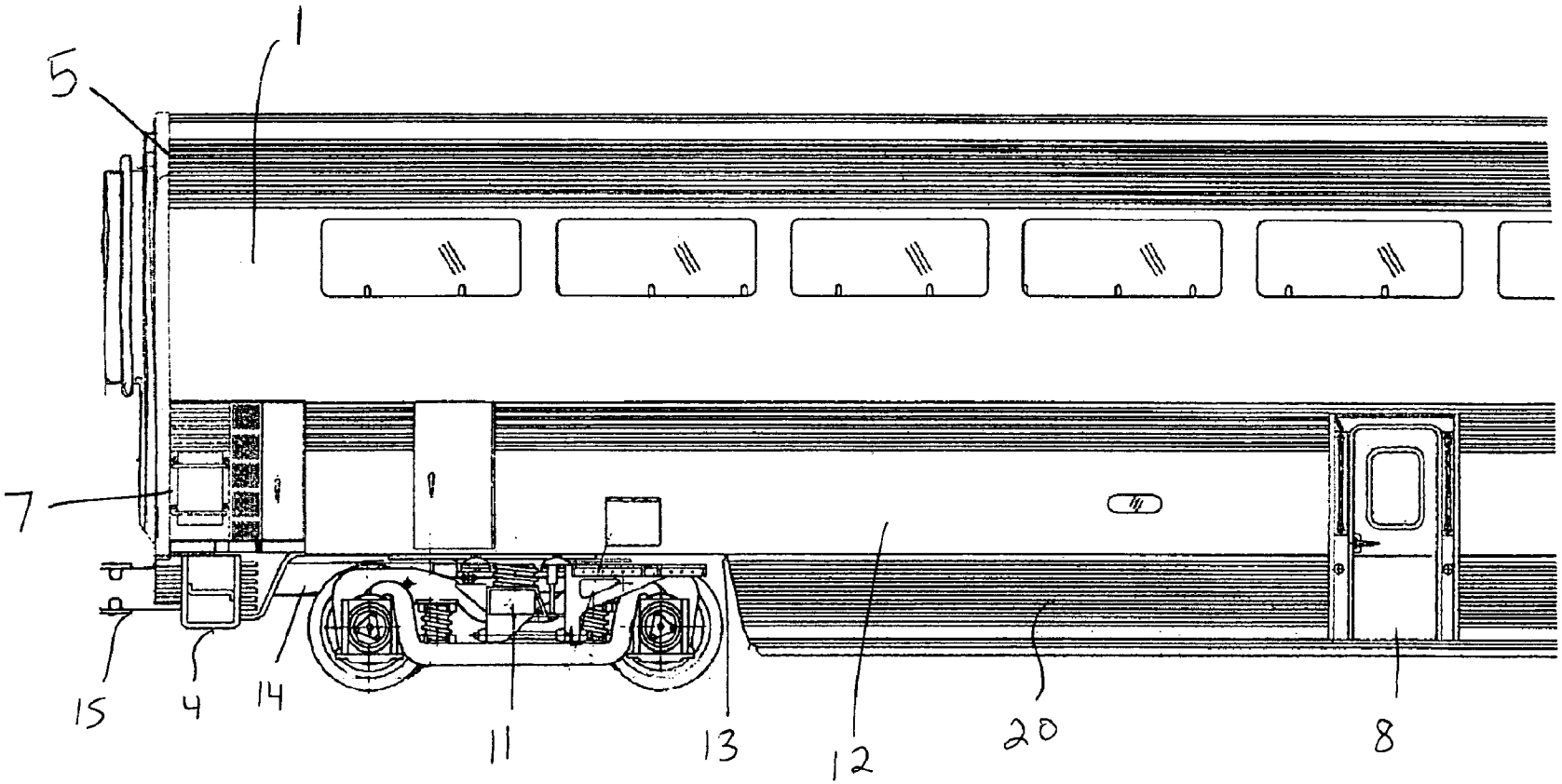
FIG. 7 is an enlarged partial side elevation of the passenger car of FIG. 1.
Figure 9:
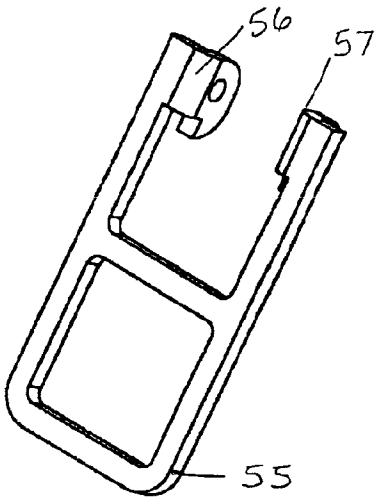
FIG. 9 is an enlarged isometric view of a first embodiment of a model passenger car step according to the present invention.
Figure 10:
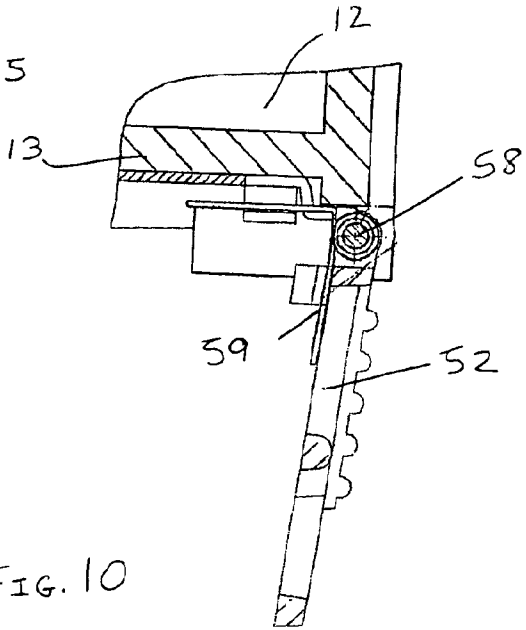
FIG. 10 is an enlarged cross-section through a portion of the train car of FIG. 8 showing a step attached by a hinged pin to the train car body.
Figure 8:
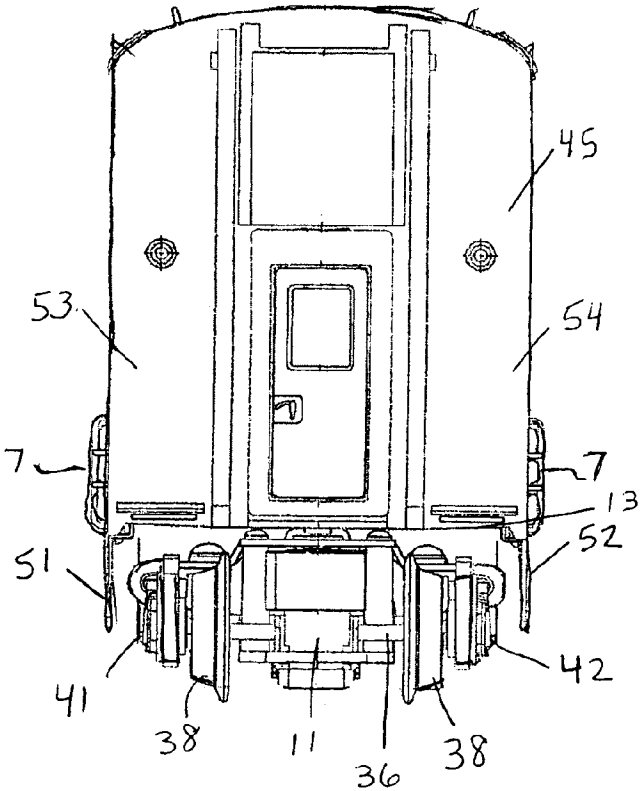
FIG. 8 is an end view of the passenger car of FIG. 1 displaying the normal position of the steps in relation to the truck and coupler assembly.

FIG. 7 shows one end of a passenger car train section according to the present invention, focusing on the step and the truck and coupler assembly section of the train car. Related to this figure, FIGS. 8 through 10 provide some further detail on the attachment of the step to the passenger car. In the rear view of the passenger car in FIG. 8, the smallness of the distance between the left and right movable steps 51, 52 and the left and right outer sides 53, 54 of the train car is evident. The step piece 55 of FIG. 9 is a ladder type step with two rungs and two top portions 56, 57, each with an opening receptive to a pin 58. The step is normally constructed of either plastic or metal. As can be seen from FIG. 10, the step is attached to the main train car body by a pin inserted through the openings in the top portions of the step and into a hinge part 59 of the model train car body. This type of construction allows the step to move out away from train car when contact from any part of the truck and coupler assembly is applied to the step. It should be noted that various designed steps and various types of attachment can be used to achieve this same objective.

Figure 11:
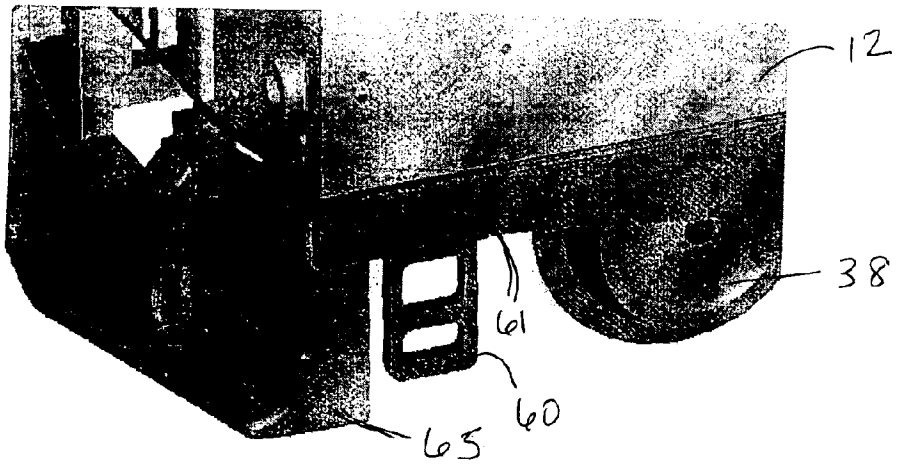
FIG. 11 is a partial isometric view of a side and end of a model passenger car according to the present invention.
Figure 12:
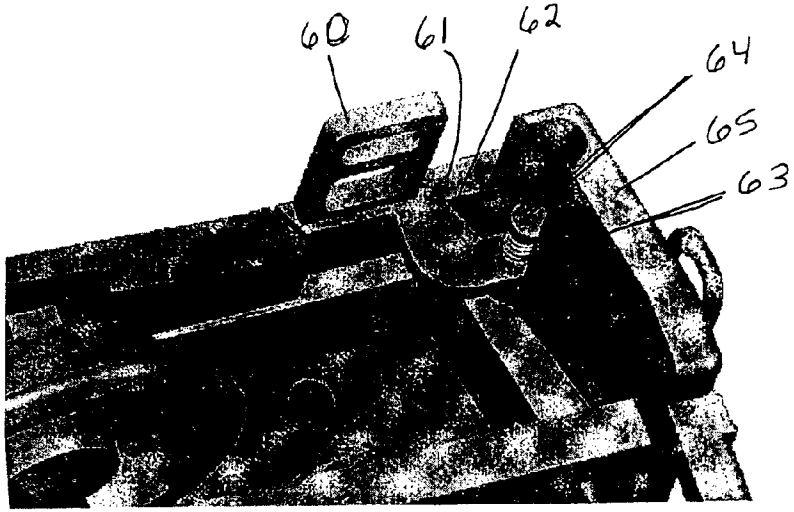
FIG. 12 is an isometric view of a portion of the underside of the train car of FIG. 11 showing a step pivotally connected by a connecting arm and pin.

In another embodiment, FIG. 11 shows a step 60 with the top of the step extending out in a top section 61. The top section not only resembles the surrounding train car body section, but also provides a connection to the train car, as is seen in the underside view of the train car in FIG. 12. The top section has a connecting arm 62, extending out from the back of the step and containing an opening 63 in its end through which a pin 64 can be inserted to hold the step piece in place and to provide pivotal movement of the step attached to the train pilot 65 away from the train car when the step is contacted by any part of the truck and coupler assembly as the train car negotiates a curve in the train track layout.

Figure 13:
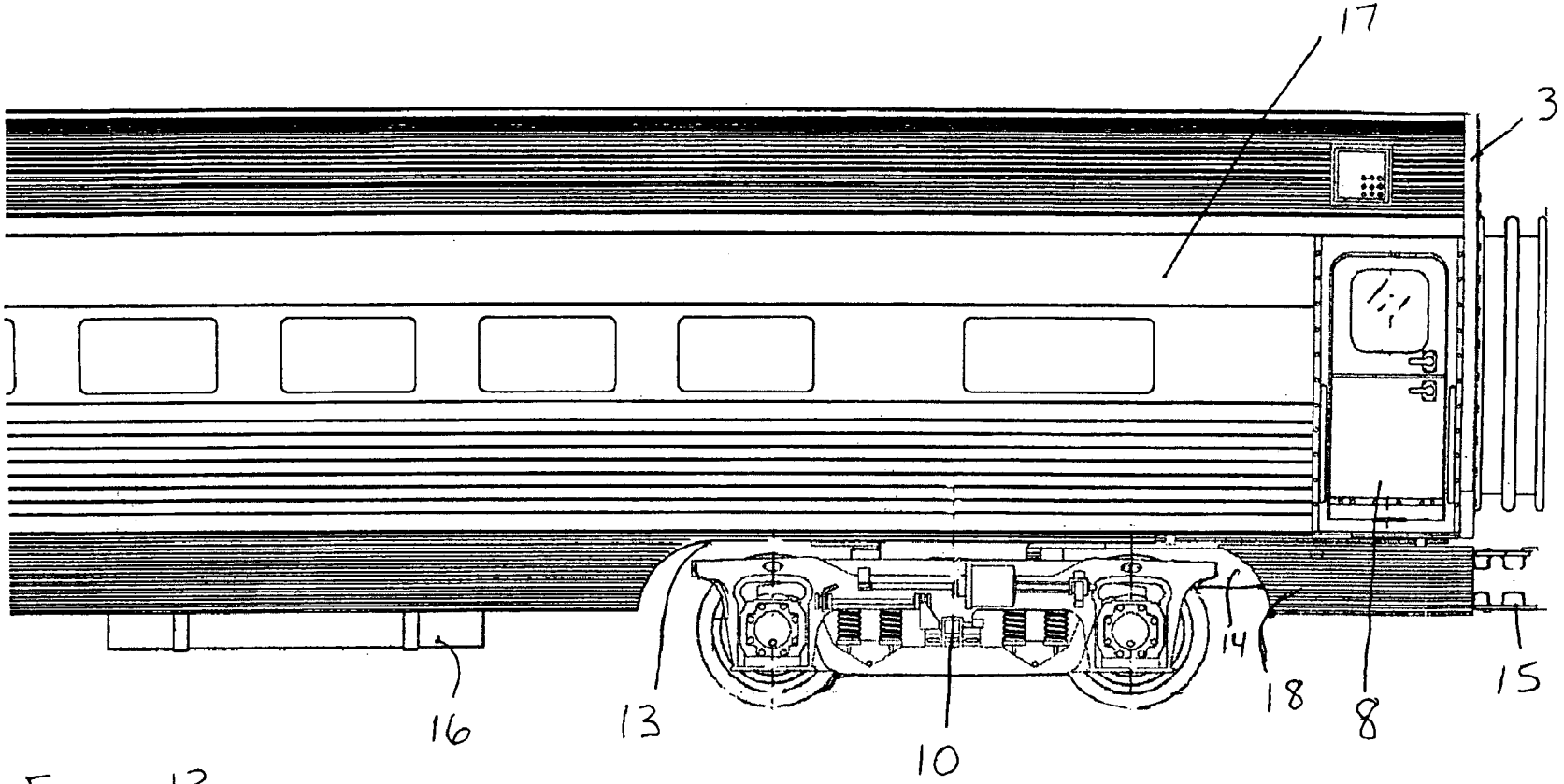
FIG. 13 is an enlarged partial side elevation of the passenger car of FIG. 2.
Figure 15:
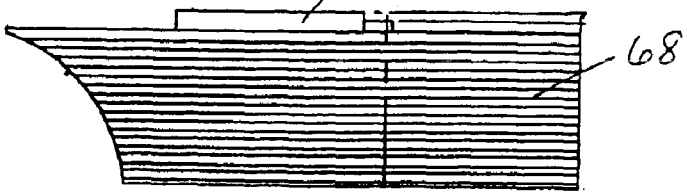
FIG. 15 is an enlarged side view of one of the skirts of FIG. 14.
Figure 16:
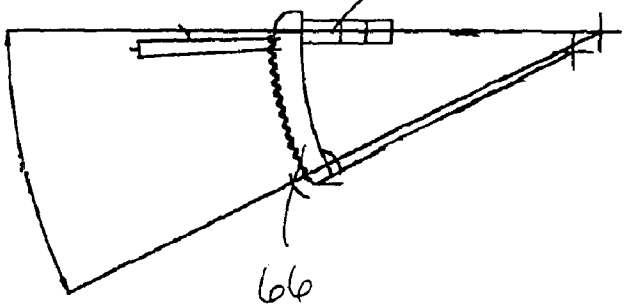
FIG. 16 shows the skirt of FIG. 14 as it swings out from the car body.
Figure 14:
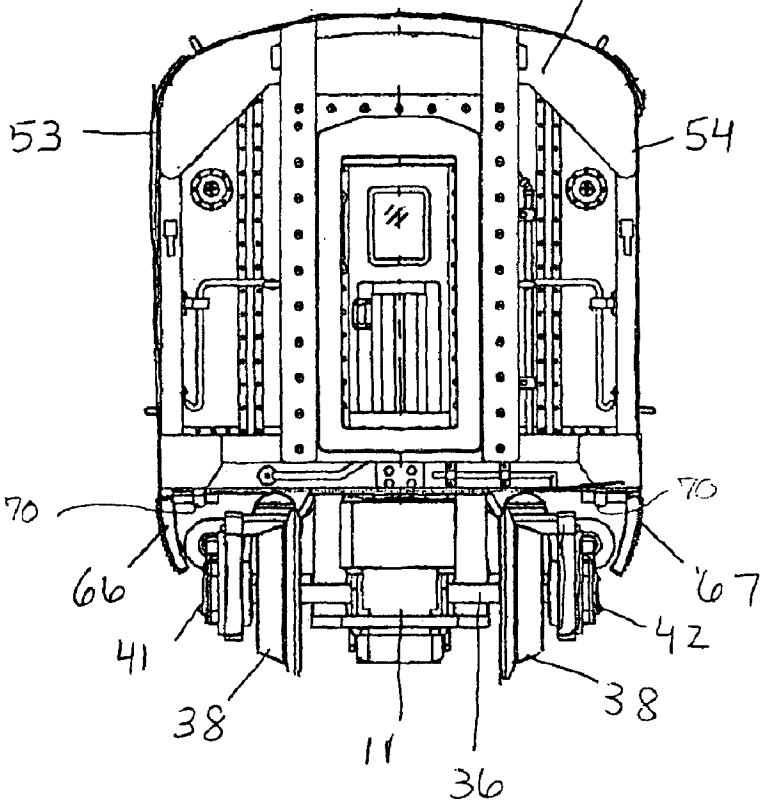
FIG. 14 is an end view of the passenger car of FIG. 13 displaying the normal position of skirts in relation to the truck and coupler assembly.

FIG. 13 depicts the end portion of another model train passenger car with a skirt, or side panel, located near the truck and coupler assembly. FIGS. 14 through 16 detail operation and construction of the train car and skirt of FIG. 13. Given the rear view of the passenger car in FIG. 14, the smallness of the distance between the left and right movable skirts 66, 67 and the left and right outer sides of the train car is evident. A skirt portion 68 shown in FIG. 15 is thin and long and normally constructed of either plastic or metal. One top portion 69 of the skirt is constructed with an opening to receive a pin or other connecting means 70 attached in a hinge-like fashion to the train car body which would allow the train car skirt to move out from the train car and avoid obstruction of the truck and coupler assembly operation. FIG. 16 illustrates the possible extent of movement of the left side skirt, depicted in FIG. 14, as attached to the train car body, so that it can move away from the train car as the truck and coupler assembly pushes the skirt away from obstruction.

Figure 17:
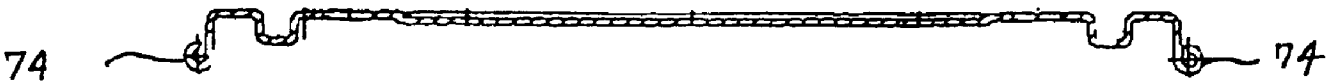
FIG. 17 is a transverse cross-section of the floor of a car, having curved ends for pivotally supporting steps.
Figure 19:
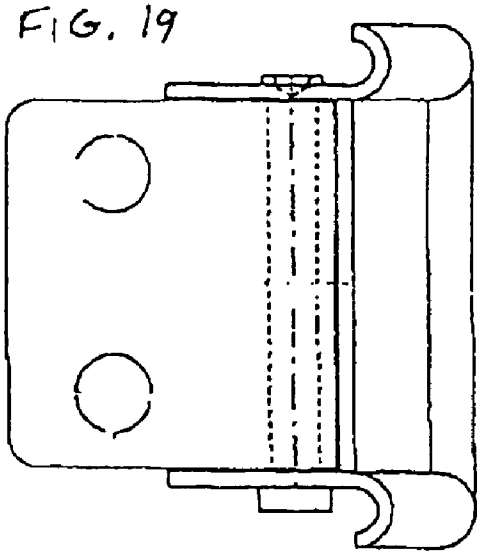
FIG. 19 shows another detail of a hinged step.
Figure 18:
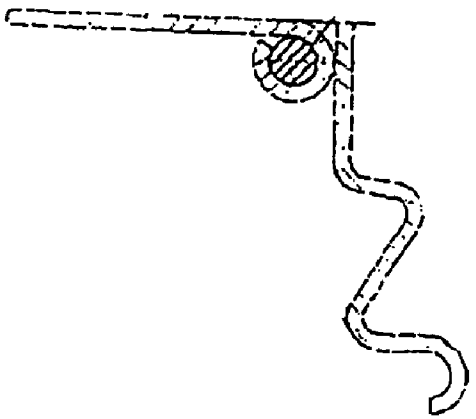
FIG. 18 shows one detail of a hinged step.

FIG. 17 shows an embodiment in which edges of a side of a car have curved portions 74 to hold hinge pins on which the steps, for example, the steps 52 of FIGS. 8–10, can be pivotally mounted.

Figure 20:
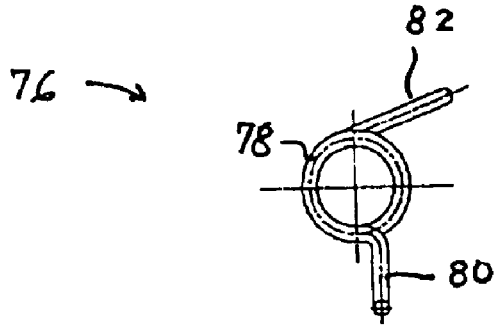
FIG. 20 is a side view of a spring used to return the step of FIG. 10 to its normal position.
Figure 21:
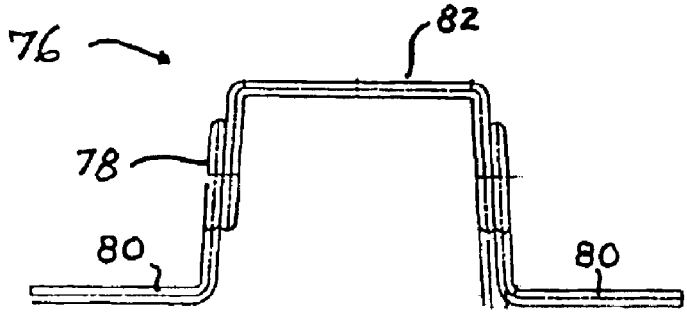
FIG. 21 is a top view of the spring of FIG. 20.

As can be seen from FIGS. 20 and 21, a spring 76 having a coiled center portion 78, end prongs 80 lying in one plane, and a central U-shaped portion 82 extending outward from the coiled portion in another plane is used to return the steps 52 to their normal position. The hinge pin, for example, hinge pin 58 of FIG. 10, extends through the coiled portion 78 of the spring, the end prongs 80 are secured to the car, and the U-shaped portion 82 is secured to the step 52.

Figure 22:
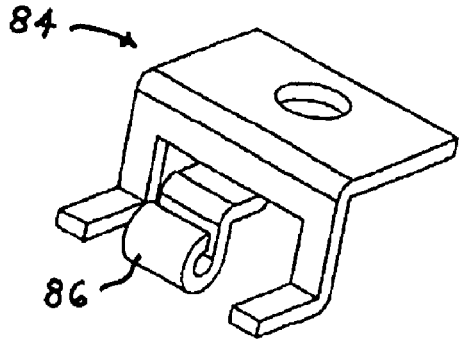
FIG. 22 is an isometric view of a support member for supporting a step according to the present invention.

As can be seen from FIG. 22, the step can be pivotally mounted on a support member 84 which can be secured to the underside of a car by, for example, a screw. The support member has a curved portion 86 to accept a pivot pin, such as the pin 58 of FIG. 10, on which the step is pivotally mounted.

Figure 23:
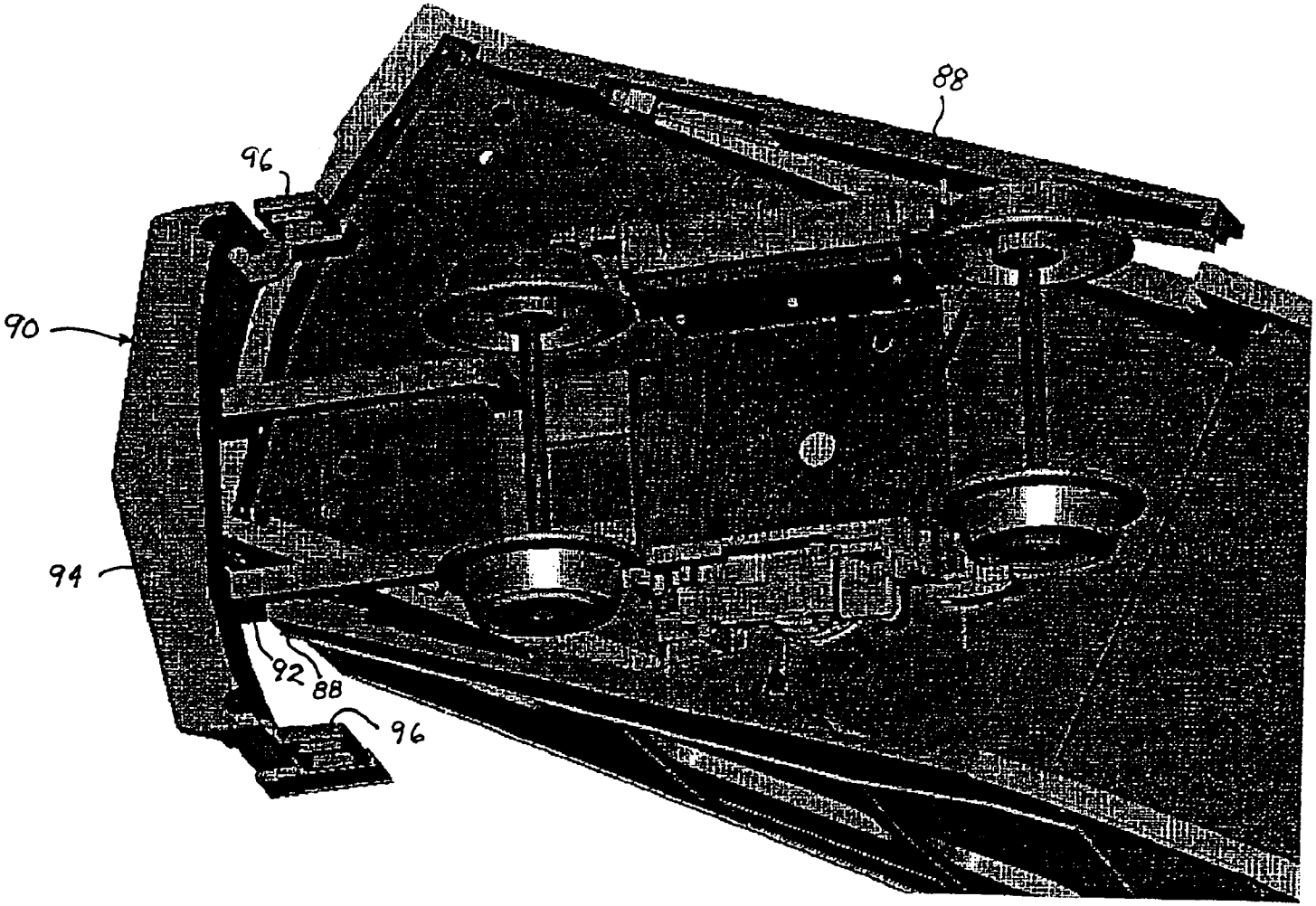
FIG. 23 is a bottom plan view of an end of a train car according to another embodiment of the present invention.

As can been seen from FIG. 23, in accordance with another embodiment of the present invention, skirts 88 depending from the sides of the train car can be mounted to move outward to accommodate movement of the truck and coupler assembly 90, both adjacent to the end of the car and closer to the center of the car. The truck and coupler assembly 90 has members 92 extending toward the end of the car and supporting a pilot 94. As the truck and coupler assembly 90 turns beyond a certain angle, one of the members 92 engages an inside surface of one skirt 88. The skirts 88 are mounted for turning movement, such as pivoting movement, outward to accommodate the turning of the truck and coupler assembly 90, as can be seen in FIG. 23. The end of the truck and coupler assembly opposite to the members 92 engages a portion of the opposite skirt 88 at a point closer to the center of the car. The skirts 88 are mounted for turning, such as pivoting, movement outward to accommodate the turning movement of the adjacent portion of the truck and coupler assembly 90. Thus, the skirts 88 are mounted for movement at opposite ends. To achieve this, a pivot pin and spring arrangement using the same principle as the pin and spring arrangements shown in FIGS. 10, 20 and 21 can be used between the center of each skirt 88 and the supporting portion of the train car from which the skirt depends.

In order to avoid frictional restriction on the turning of the train wheels adjacent to the portions of the skirts near the center of the train car, pins extend laterally outward from the sides of the truck and coupler assembly 90 to engage the inner surface of the skirts, so that the wheels do not touch the skirts. In this regard, recesses are provided on the interior of the skirts to accommodate portions of the wheels.

Also in connection with FIG. 23, steps 96 are mounted on the pilot to move with the pilot as the truck and coupler assembly 90 turns. In this way, the steps do not interfere with the turning movement of the truck and coupler assembly.

Although not depicted in the drawings presented here, there are a number of other suitable methods for connecting model train steps, skirts or other train parts to the model train car which would allow movement of the said part to avoid resistant contact with the truck and coupler assembly as it maneuvers around a tight curve in the model train track layout.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

What is claimed is:

1. A model train car comprising:

a car body;

at least one truck and coupler assembly, wherein said assembly is movably attached to said car body so as to define a range of movement, and wherein said car body includes a portion extending into the range of movement; and means for enabling said portion to move out of the range of movement of said assembly.

2. The model train car of claim 1, wherein said truck and coupler assembly includes wheels for engaging track rails and a coupler for connecting the model train car to another model train car.

3. The model train car of claim 1, wherein the model train car is adapted to travel on a track defining a plane, and the range of movement of said truck and coupler assembly is in a plane generally parallel to the plane of the track.

4. The model train car of claim 1, wherein the model train car has a bottom, and the range of movement of said truck and coupler assembly is in a plane generally parallel to said bottom.

5. The model train car of claim 1, wherein said means for enabling comprises a pivot connection pivotally mounting the portion of the car body extending into said range of movement to another portion of the car body.

6. The model train car of claim 5, wherein said pivot connection has a vertical pivot axis.

7. The model train car of claim 6, wherein the portion of the car body extending into the range of movement of said truck and coupler assembly has opposite ends, and said pivot connection is positioned adjacent one of said ends.

8. The model train car of claim 6, wherein the portion of the car body extending into the range of movement of said truck and coupler assembly has opposite ends, and said pivot connection is positioned intermediate said ends.

9. The model train car of claim 8, wherein a first portion of said truck and coupler assembly defines a first range of movement, a second portion of said truck and coupler assembly defines a second range of movement, and wherein said car body portion that extends into the range of movement comprises a first part that extends into said first range of movement and a second part that extends into said second range of movement.

10. The model train car of claim 5, wherein said pivot connection has a horizontal pivot axis.

11. The model train car of claim 10, wherein the model train car has a longitudinal axis, and said horizontal pivot axis is parallel to said longitudinal axis.

12. The model train car of claim 10, wherein said horizontal pivot axis is above all portions of the truck and coupler assembly into the range of movement of which the portion of said car body extends.

13. The model train car of claim 1, wherein said portion comprises steps.

14. The model train car of claim 1, wherein said portion comprises a skirt.

15. The model train car of claim 1, further comprising an arrangement resiliently biasing said portion into the range of movement.

16. A model train car comprising:

a car body;

at least one truck and coupler assembly, wherein said assembly is movably attached to said car body so as to define a range of movement, and wherein said car body includes a portion extending into the range of movement; and a connection mounting said portion on the rest of said car body such that said portion is able to move out of the range of movement of said assembly.

17. The model train car of claim 16, wherein said truck and coupler assembly includes wheels for engaging track rails and a coupler for connecting the model train car to another model train car.

18. The model train car of claim 16, wherein the model train car is adapted to travel on a track defining a plane, and the range of movement of said truck and coupler assembly is in a plane generally parallel to the plane of the track.

19. The model train car of claim 16, wherein the model train car has a bottom, and the range of movement of said truck and coupler assembly is in a plane generally parallel to said bottom.

20. The model train car of claim 16, wherein said connection comprises a pivot connection pivotally mounting the portion of the car body extending into said range of movement to another portion of the car body.

21. The model train car of claim 20, wherein said pivot connection has a vertical pivot axis.

22. The model train car of claim 21, wherein the portion of the car body extending into the range of movement of said truck and coupler assembly has opposite ends, and said pivot connection is positioned adjacent one of said ends.

23. The model train car of claim 21, wherein the portion of the car body extending into the range of movement of said truck and coupler assembly has opposite ends, and said pivot connection is positioned intermediate said ends.

24. The model train car of claim 23, wherein a first portion of said truck and coupler assembly defines a first range of movement, a second portion of said truck and coupler assembly defines a second range of movement, and wherein said car body portion that extends into the range of movement comprises a first part that extends into said first range of movement and a second part that extends into said second range of movement.

25. The model train car of claim 20, wherein said pivot connection has a horizontal pivot axis.

26. The model train car of claim 25, wherein the model train car has a longitudinal axis, and said horizontal pivot axis is parallel to said longitudinal axis.

27. The model train car of claim 25, wherein said horizontal pivot axis is above all portions of the truck and coupler assembly into the range of movement of which the portion of said car body extends.

28. The model train car of claim 16, wherein said portion comprises steps.

29. The model train car of claim 16, wherein said portion comprises a skirt.

30. The model train car of claim 16, further comprising an arrangement resiliently biasing said portion into the range of movement.

* * * * *